US012422199B2

(12) United States Patent
Zhang

(10) Patent No.: US 12,422,199 B2
(45) Date of Patent: Sep. 23, 2025

(54) MULTI-CHANNEL LIQUID COOLING RADIATOR

(71) Applicant: Shenzhen Liquid Cooling Technology Co. Ltd., Shenzhen (CN)

(72) Inventor: Zhenmin Zhang, Shenzhen (CN)

(73) Assignee: SHENZHEN LIQUID COOLING TECHNOLOGY CO. LTD., Shenzhen (CN)

( * ) Notice: Subject to any disclaimer, the term of this patent is extended or adjusted under 35 U.S.C. 154(b) by 245 days.

(21) Appl. No.: 18/476,327

(22) Filed: Sep. 28, 2023

(65) Prior Publication Data

US 2024/0110753 A1 Apr. 4, 2024

(30) Foreign Application Priority Data

Sep. 30, 2022 (CN) ..... 202222610494.8

(51) Int. Cl.
*F28F 3/04* (2006.01)

(52) U.S. Cl.
CPC ..... *F28F 3/048* (2013.01); *F28F 2215/08* (2013.01)

(58) Field of Classification Search
CPC ... H01L 23/4735; H01L 23/473; H01L 23/46; H01L 23/40; F28D 2021/0029; F28D 2021/0028; F28F 3/048; F28F 2215/08
USPC ..... 165/104.33, 80.4, 80.3
See application file for complete search history.

(56) References Cited

U.S. PATENT DOCUMENTS

| | | | | |
|---|---|---|---|---|
| 9,345,169 | B1 * | 5/2016 | Campbell | H05K 7/20327 |
| 10,739,084 | B2 * | 8/2020 | Tsai | H05K 7/20254 |
| 11,334,126 | B2 * | 5/2022 | Tsai | G06F 1/20 |
| 12,099,385 | B2 * | 9/2024 | Tsai | G06F 1/20 |
| 12,158,786 | B2 * | 12/2024 | Tsai | F04D 29/586 |
| 12,200,903 | B2 * | 1/2025 | Chiang | H01L 23/473 |
| 12,279,398 | B2 * | 4/2025 | Zhang | H05K 7/20272 |
| 2006/0185829 | A1 * | 8/2006 | Duan | H01L 23/473 257/E23.098 |
| 2012/0152498 | A1 * | 6/2012 | Lyon | H01L 23/473 165/104.19 |
| 2016/0363967 | A1 * | 12/2016 | Tsai | H05K 7/20272 |
| 2017/0045300 | A1 * | 2/2017 | Boday | H05K 7/20772 |
| 2017/0045307 | A1 * | 2/2017 | Tsai | H01L 23/473 |
| 2017/0192471 | A1 * | 7/2017 | Tsai | H01L 23/473 |
| 2018/0139865 | A1 * | 5/2018 | Draht | H01L 23/473 |
| 2018/0213677 | A1 * | 7/2018 | Wu | H01L 23/473 |
| 2018/0259267 | A1 * | 9/2018 | Tsai | H05K 7/20263 |
| 2018/0340744 | A1 * | 11/2018 | Tsai | F28D 15/00 |
| 2020/0227341 | A1 * | 7/2020 | Neal | F28F 3/12 |
| 2022/0084905 | A1 * | 3/2022 | Koyama | H05K 7/20 |
| 2024/0110753 | A1 * | 4/2024 | Zhang | F28F 3/048 |
| 2024/0290686 | A1 * | 8/2024 | Refai-Ahmed | H01L 23/427 |

(Continued)

*Primary Examiner* — Claire E Rojohn, III
(74) *Attorney, Agent, or Firm* — Leong C. Lei

(57) ABSTRACT

A multi-channel liquid cooling radiator includes a heat sink base and a fin unit on the heat sink base. The fin unit has at least three guide grooves. A flow guide structure is provided on the heat sink base. The flow guide structure includes at least two diversion grooves and at least one confluence groove. Through the arrangement of multiple guide grooves and the flow guide structure, the flow direction of a coolant is changed, the travel distance of the coolant is shortened, the flow resistance is reduced, and the thermal conductivity of the liquid cooling radiator is improved.

7 Claims, 13 Drawing Sheets

(56) References Cited

U.S. PATENT DOCUMENTS

2025/0056762 A1* 2/2025 Zhang ..... H01L 23/473
2025/0234486 A1* 7/2025 Syu ..... H05K 7/20272

* cited by examiner

MULTI-CHANNEL LIQUID COOLING RADIATOR

BACKGROUND OF THE INVENTION

1. Field of the Invention

The present invention relates to a radiator, and more particularly to a multi-channel liquid cooling radiator used to dissipate heat for CPUs.

2. Description of the Prior Art

Radiators are widely used in electronic products, such as computer cases, laptops, and servers. For example, a radiator for a CPU includes a plurality of thin fins on a heat sink block made of copper or aluminum. The flow resistance of water inside the gap between the fins is greater, resulting in poor heat dissipation.

Chinese Patent Publication No. CN103066035 discloses an improved heat sink block of a liquid cooling radiator for a CPU and a manufacturing method thereof. The heat sink block of the liquid cooling radiator includes a base having a top and a bottom and a fin unit disposed on the base for heat dissipation. As shown in FIG. 13, the middle of the top of the base is formed with a recess 13' that is recessed inwardly. The fin unit 11' includes a plurality of fins 111' that extend outwardly, perpendicularly from the bottom wall of the recess and are arranged in parallel. Some or all of the fins of the fin unit each have a notch 112' formed on the middle of the top edge thereof. The notches 112' of the fins form a guide groove 12' running through the tops of some or all of the fins. The method for manufacturing the heat sink block of the liquid cooling radiator includes the steps of forming a semi-finished heat sink block, forming a guide groove, forming a recess, forming fins and forming the heat sink block. In the heat sink block of the liquid cooling radiator, the coolant enters the fin unit 11' in the S1 direction via the guide groove 12' in the middle of the top edge of the fin unit 11', and then the coolant is divided into two streams S2 and S3 to flow out from the two ends of the spacing between the adjacent fins 111's, thereby improving the heat conduction and heat dissipation performance of the heat sink block.

Although the length of the liquid cooling microchannel structure has been shortened by half through the guide groove, the flow resistance of the microchannel is still relatively large, resulting in excessive flow resistance of the entire circulation system. It is difficult to improve the heat dissipation efficiency. For products with higher heat dissipation requirements, it is still difficult to meet customer needs.

Therefore, there is a need to study a new technical solution to solve the above problems.

SUMMARY OF THE INVENTION

In view of the deficiencies of the prior art, the primary object of the present invention is to provide a multi-channel liquid cooling radiator, which can change the flow direction of the coolant, shorten the travel distance of the liquid to be guided out, and reduce the flow resistance in the microchannels inside the spacing of the fins effectively. It is beneficial to increase the flow rate, thereby improving the thermal conductivity of the liquid cooling radiator.

In order to achieve the foregoing object, the present invention adopts the following technical solutions:

A multi-channel liquid cooling radiator comprises a heat sink base and a fin unit on the heat sink base. The fin unit includes a plurality of fins that are arranged in parallel and spaced apart in a front-rear direction.

All or some of the fins of the fin unit each have at least three notches spaced apart in a left-right direction on a top thereof. The notches, corresponding to each other in the front-rear direction, of the fins together form a guide groove extending in the front-rear direction, such that the top of the fin unit form at least three guide grooves spaced apart in the left-right direction.

A flow guide structure is provided on the heat sink base. The flow guide structure includes at least two diversion grooves and at least one confluence groove. The diversion grooves and the confluence groove are arranged in parallel and spaced apart in the left-right direction. The confluence groove is located between every adjacent two of the diversion grooves. The diversion grooves pass through upper and lower ends of the flow guide structure. The confluence groove passes through the lower end of the flow guide structure. A front end and/or a rear end of the flow guide structure is formed with a liquid outlet communicating with the confluence groove.

Lower ends of the diversion grooves and the confluence groove communicate with the corresponding guide grooves, respectively. After a liquid enters the corresponding guide grooves from the diversion grooves, the liquid is diverted to flow left and right in a spacing between the fins, the liquid in the spacing of the fins at left and right sides of the guide groove corresponding to the confluence groove flows into the confluence groove, and then the liquid flows out from the liquid outlet of the confluence groove.

Compared with the prior art, the present invention has obvious advantages and beneficial effects. Specifically, it can be known from the above technical solution that through the plurality of guide grooves of the fin unit on the heat sink base and the special structural arrangement of the diversion grooves and the confluence groove of the guide structure, after a liquid enters the corresponding guide groove from the diversion groove, the liquid is diverted to flow left and right in the spacing of the fins 111. The liquid in the spacing of the fins at the left and right sides of the guide groove corresponding to the confluence groove flows into the confluence groove, and then the liquid flows out from the liquid outlet of the confluence groove. Thus, the flow direction of the coolant is changed, and the flow resistance in the microchannels inside the spacing of the fins is reduced effectively. It is beneficial to increase the flow rate, thereby improving the thermal conductivity of the liquid cooling radiator.

DETAILED DESCRIPTION OF THE PREFERRED EMBODIMENTS

Figure 1:
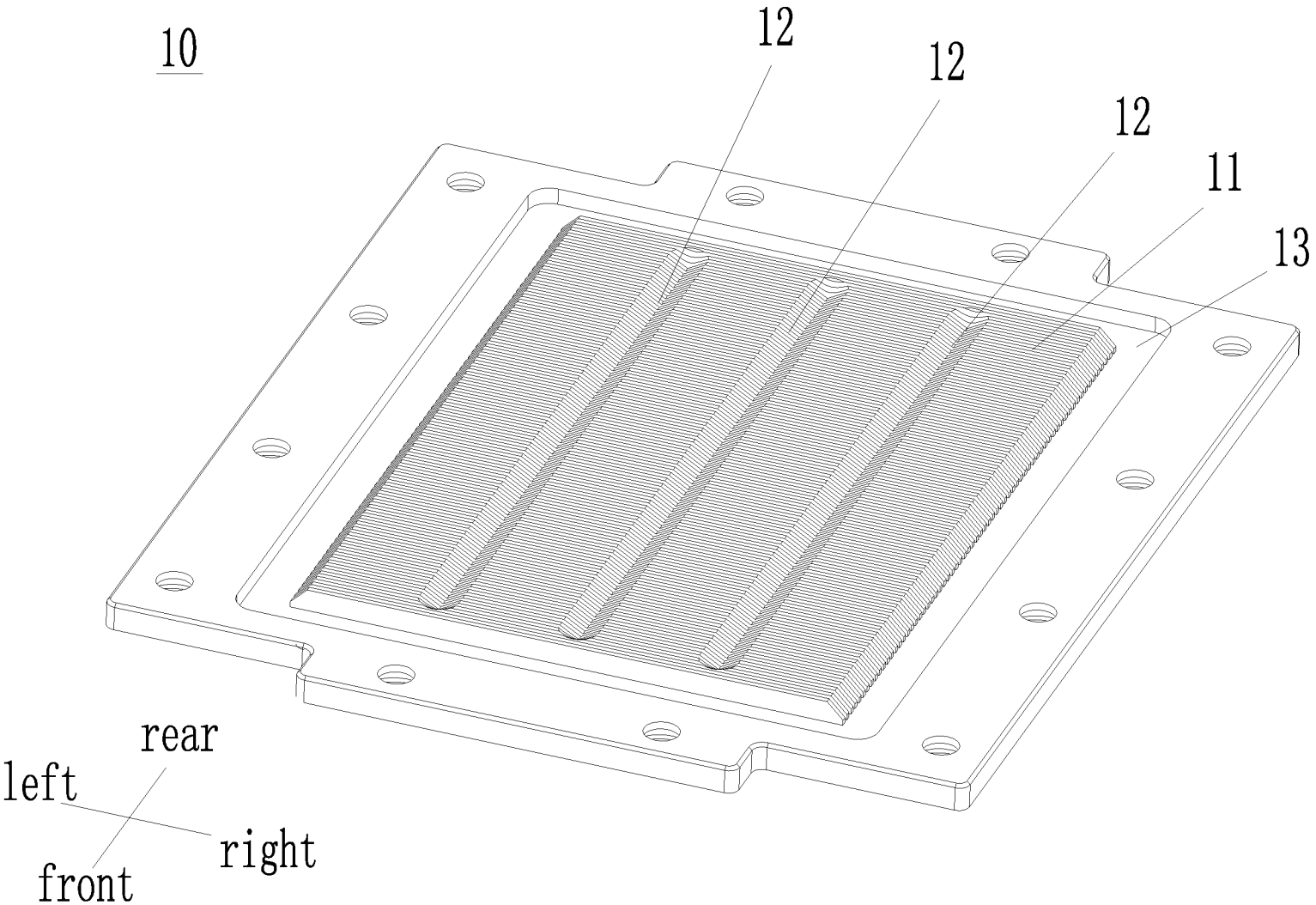
FIG. 1 is a perspective view of the heat sink base according to a first embodiment of the present invention.
Figure 2:
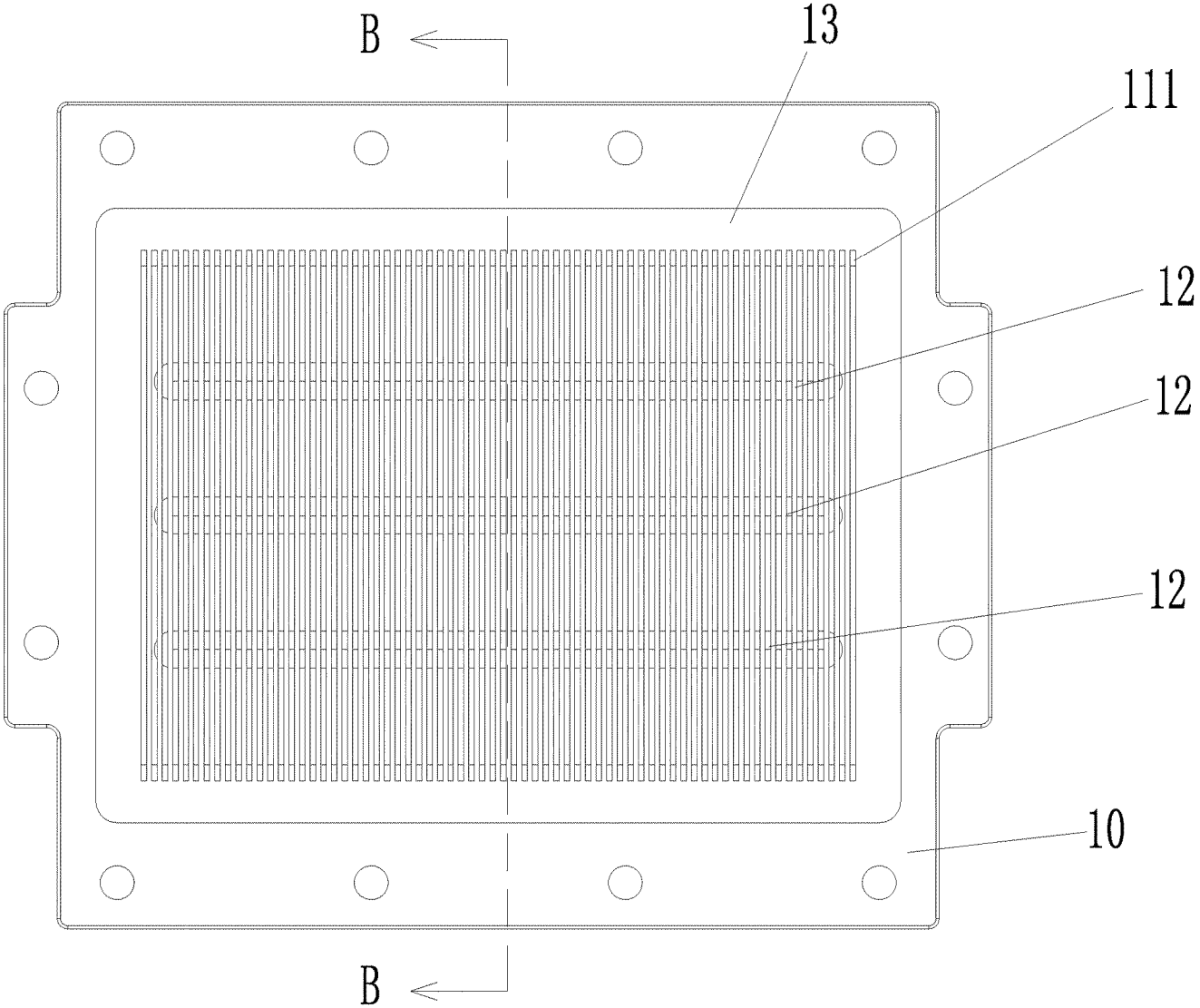
FIG. 2 is a top view of the heat sink base according to the first embodiment of the present invention.
Figure 3:
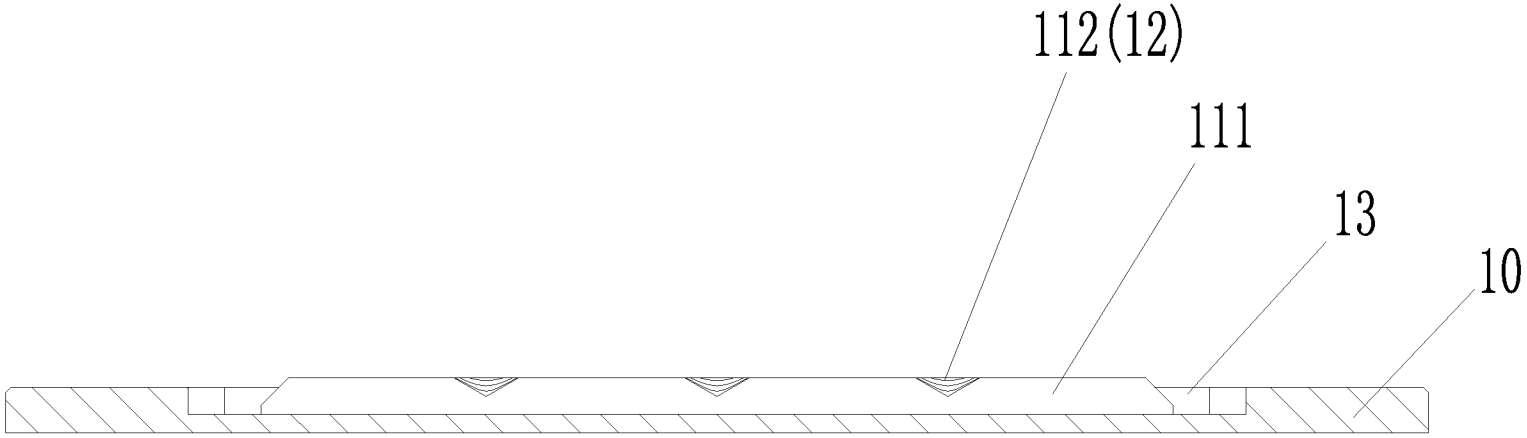
FIG. 3 is a cross-sectional view taken along line B-B of FIG. 2.
Figure 4:
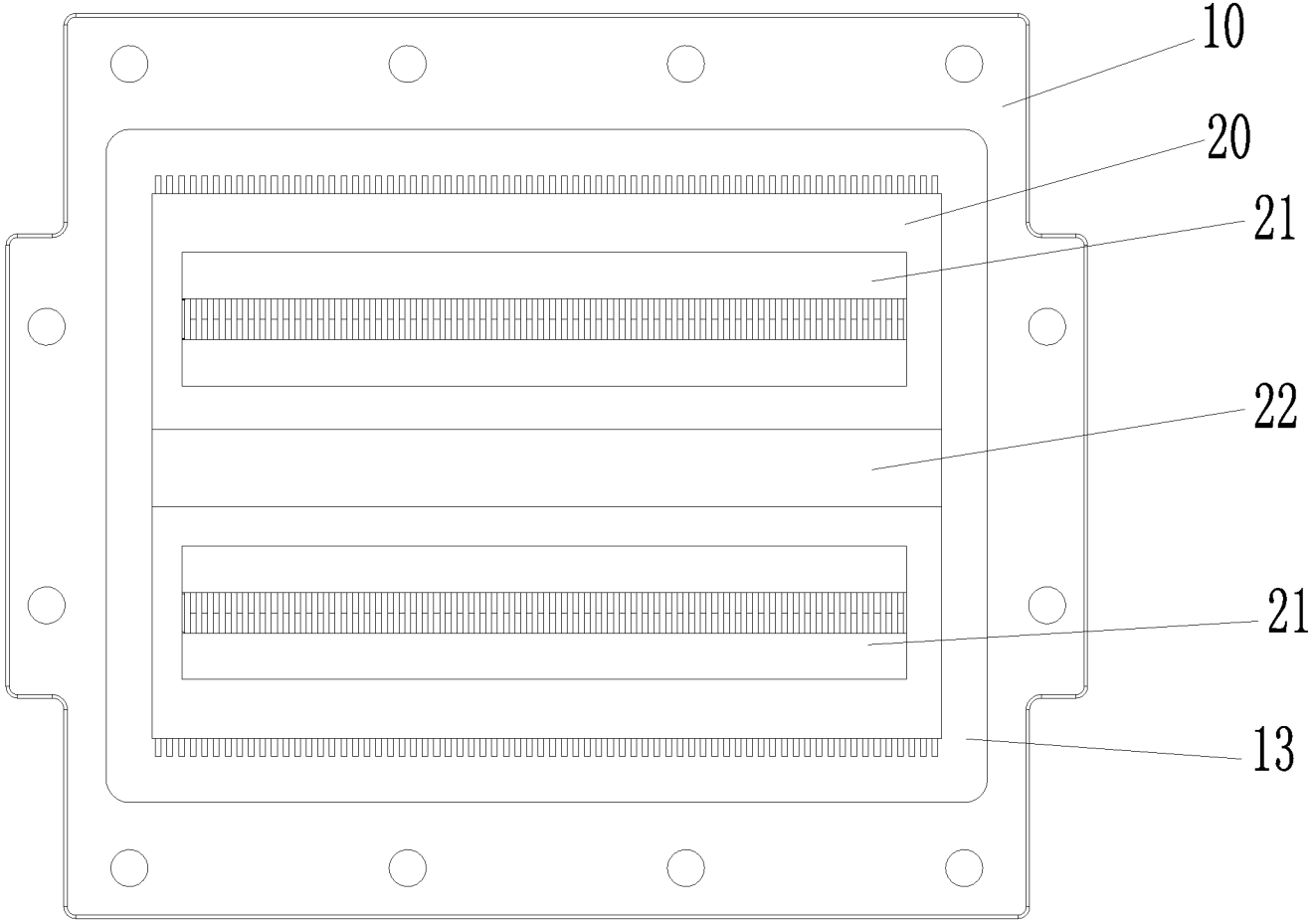
FIG. 4 is a top view of the flow guide structure disposed on the heat sink base according to the first embodiment of the present invention.
Figure 5:
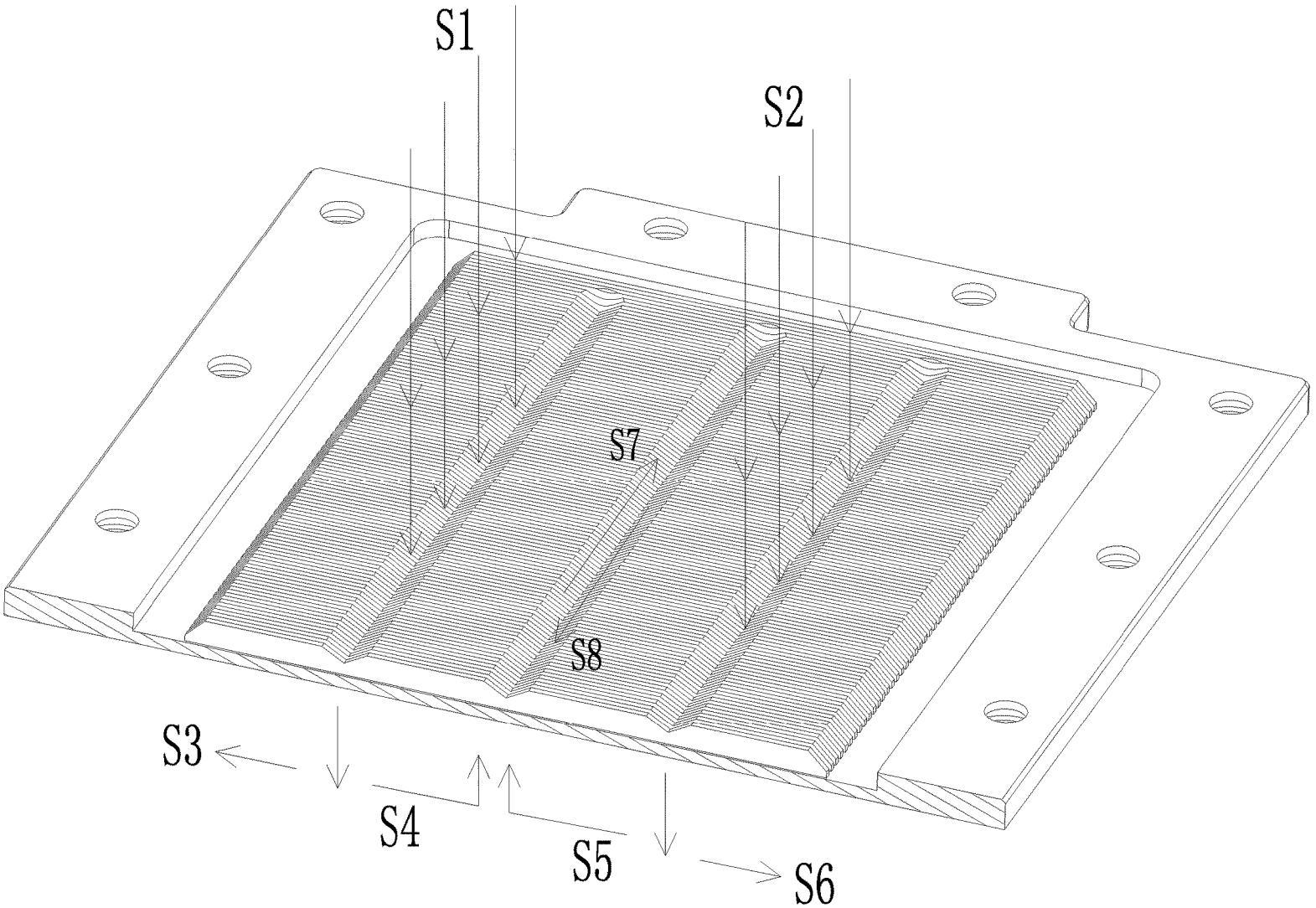
FIG. 5 is a schematic view of the flow direction of the liquid according to the first embodiment of the present invention, wherein the fin unit has three guide grooves.

FIGS. 1 through 11 show specific structures of embodiments of the present invention.

A multi-channel liquid cooling radiator comprises a heat sink base 10 and a flow guide structure 20 on top of the heat sink base 10.

A fin unit 11 is provided on the top of the heat sink base 10. The fin unit 11 includes a plurality of fins 111 that are arranged in parallel and spaced apart in a front-rear direction. Some or all of the fins 111 of the fin unit 11 each have at least three notches 112 spaced apart in a left-right direction on a top thereof. The notches 112, corresponding to each other in the front-rear direction, of the fins 111 together form a guide groove 12 extending in the front-rear direction, such that the top of the fin unit 11 form at least three guide grooves 12 spaced apart in the left-right direction. Preferably, the guide groove 12 is a V-shaped guide groove having a V-shaped cross-section. The heat sink base 10 has a recess 3 around the periphery of the fin unit 11. The left and/or right end of a spacing between every adjacent two of the fins 111 communicates with the recess 13. In this embodiment, the recess 13 is an annular recess around the fin unit 11. The recess 13 is connected to a hot liquid exit.

The flow guide structure 20 includes at least two diversion grooves 21 and at least one confluence groove 22. The diversion grooves 21 and the confluence groove 22 are arranged in parallel and spaced apart in the left-right direction. The confluence groove 22 is located between every adjacent two of the diversion grooves 21. The diversion groove 21 passes through the upper and lower ends of the flow guide structure 20. The confluence groove 22 passes through the lower end of the flow guide structure 20. The front end and/or the rear end of the flow guide structure 20 is formed with a liquid outlet 222 communicating with the confluence groove 22. The liquid outlet 222 of the confluence groove 22 communicates with the recess 13. The lower ends of the diversion grooves 21 and the confluence groove 22 communicate with the corresponding guide grooves 12, respectively. After a liquid enters the corresponding guide groove 12 from the diversion groove 21, the liquid is diverted to flow left and right in the spacing of the fins 111. The liquid in the spacing of the fins 111 at the left and right sides of the guide groove 12 corresponding to the confluence groove 22 flows into the confluence groove 22, and then the liquid flows out from the liquid outlet 222 of the confluence groove 22 to the recess 13. The lower ends of the diversion grooves 21 and the confluence groove 22 communicate with the corresponding guide grooves 12 one by one, so that after the liquid enters the corresponding guide groove 12 from the diversion groove 21, the liquid is diverted to flow left and right in the spacing of the fins 111, and the liquid in the spacing of the fins 111 at the left and right sides of the guide groove 12 corresponding to the confluence groove 22 flows into the confluence groove 22 and then flows out from the liquid outlet 222 of the confluence groove 22 to the recess 13. Through the confluence groove 22, it is easy to converge and guide out the liquid between the two guide grooves 12 located at the leftmost end and the rightmost end. In this way, through the plurality of guide grooves 12 of the fin unit 11 on the heat sink base 10 and the special structural arrangement of the diversion grooves 21 and the confluence groove 22 of the guide structure 20, the flow direction of the coolant is changed, and the travel distance of the liquid to be guided out is shortened, so as to reduce the flow resistance in the micro-channels inside the spacing of the fins effectively and increase the flow rate, thereby improving the thermal conductivity of the liquid cooling radiator. Otherwise, if there is no confluence groove 22 and liquid outlet 222, even if multiple guide grooves 12 are provided to divert the liquid from the liquid inlet end into multiple streams, the liquid still needs to pass through the micro-channels inside the spacing of the adjacent fins 111 to flow out via the left and right ends. The travel distance of the liquid to be guided out is long and the flow resistance is large, which will inevitably affect the smoothness and flow rate of the entire liquid circulation.

The lower end of the confluence groove 22 communicates with the upper end of the corresponding guide groove 12 via a connection opening 221. The cross-section of the connection opening 221 is smaller than that of the confluence groove 22. Thus, it is convenient for the liquid in the spacing of the fins 111 at the left and right sides of the guide groove 12 corresponding to the confluence groove 22 flows into the confluence groove 22 smoothly. The confluence groove 22 is used as a liquid outlet cavity for converging the liquid to flow out of the flow guide structure 20.

As shown in FIG. 5 and FIG. 7 through FIG. 11, the number of the guide grooves 12 spaced apart in the left-right direction is three. The guide grooves are defined from left to right as a first guide groove, a second guide groove and a third guide groove. The number of the at least two diversion grooves 21 is two. The diversion grooves 21 are defined from left to right as a first diversion groove and a second diversion groove. The number of the at least one confluence groove 22 is one. The lower end of the first diversion groove communicates with the upper end of the first guide groove. The lower end of the second diversion groove communicates with the upper end of the third guide groove. The lower end of the confluence groove 22 communicates with the upper end of the second guide groove. Through the flow guide structure 20, the liquid is divided into two streams S1 and S2 to enter the fin unit 11. After entering the fin unit 11, the stream S1 is divided into two streams S3 and S4 to flow left and right, and the stream S2 is divided into two streams S5 and S6 to flow left and right. In this way, the flow resistance in the micro-channels of the fin unit 11 is reduced greatly. Besides, the stream S4 and the stream S5 are converged to enter the second guide groove and flow upwardly to the confluence groove 22, and then flow out to the recess 13 via the liquid outlets 222 at the front and rear ends of the confluence groove 22 to form streams S7 and S8 in the confluence groove 22. (Since the front and rear ends of the flow guide structure 20 have the liquid outlets 222, the streams S7 and S8 in different directions will be formed in the confluence groove 22. If only the rear end of the flow guide structure 20 has the liquid outlet 222, the stream S7 will be formed in the confluence groove 22. Similarly, if only the front end of the flow guide structure 20 has the liquid outlet 222, the stream S8 will be formed in the confluence groove 22. The stream S3 and the stream S6 flow from the left and right ends of the fin unit 11 to the recess 13, respectively.

In the first embodiment, if the three guide grooves 12 are evenly spaced in the left-right direction, the liquid, in the form of the streams S4 and S5, near the middle of the fin unit 11 flows out from the confluence groove 22, and the liquid, in the form of the streams S3 and S6, near the left and right sides of the fin unit 11 flows from the left and right ends of the fin unit 11 to the recess 13, which shortens the travel distance of the liquid to one quarter. Compared with the prior art which uses a flow guide to shorten the length of the liquid cooling micro-channel structure by half, the present invention reduces the flow resistance in the micro-channels inside the spacing of the fins effectively, which is beneficial to increase the flow rate, thereby improving the thermal conductivity of the liquid cooling radiator.

Figure 6:
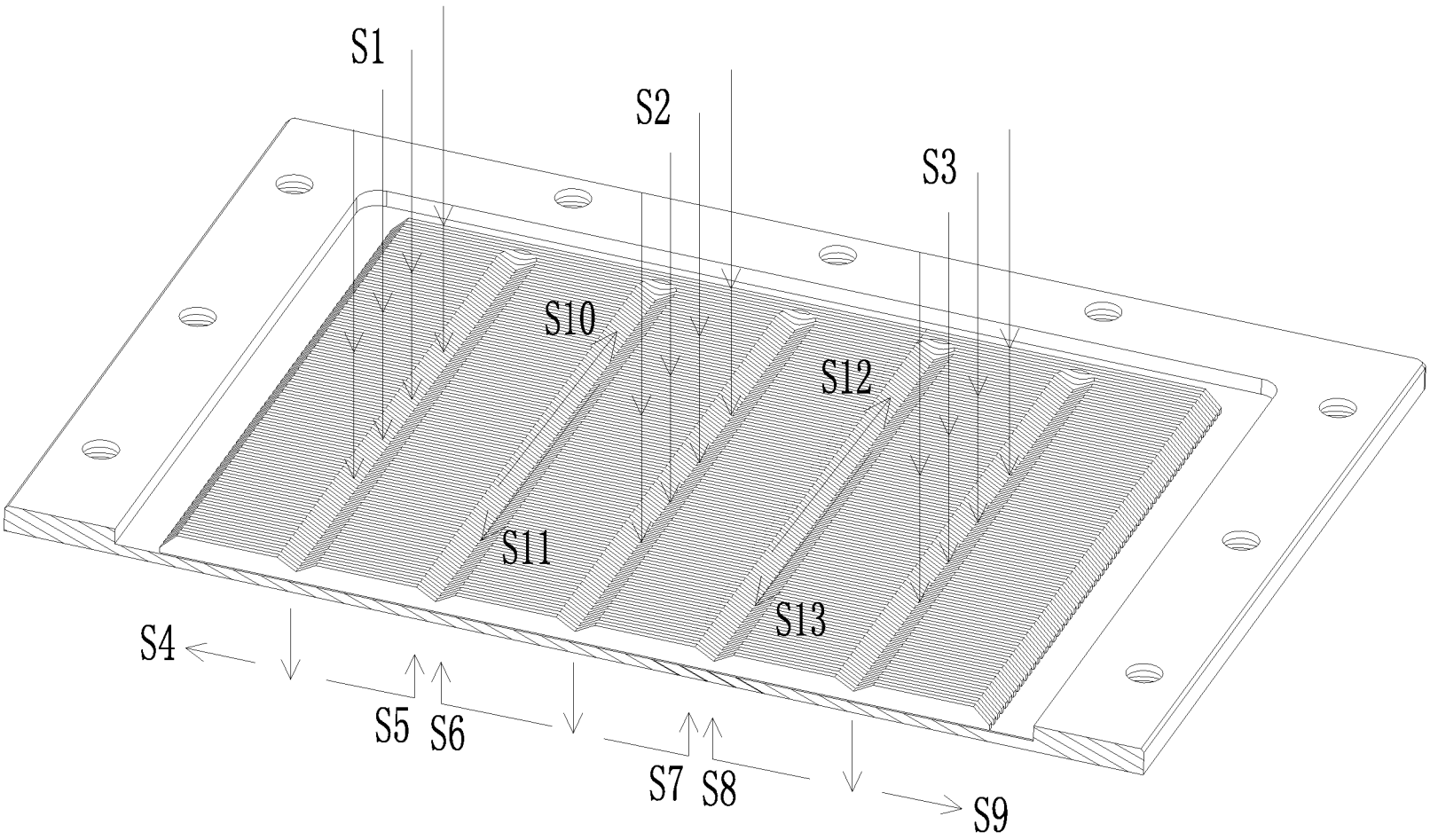
FIG. 6 is a schematic view of the flow direction of the liquid according to a second embodiment of the present invention, wherein the fin unit has five guide grooves.
Figure 7:
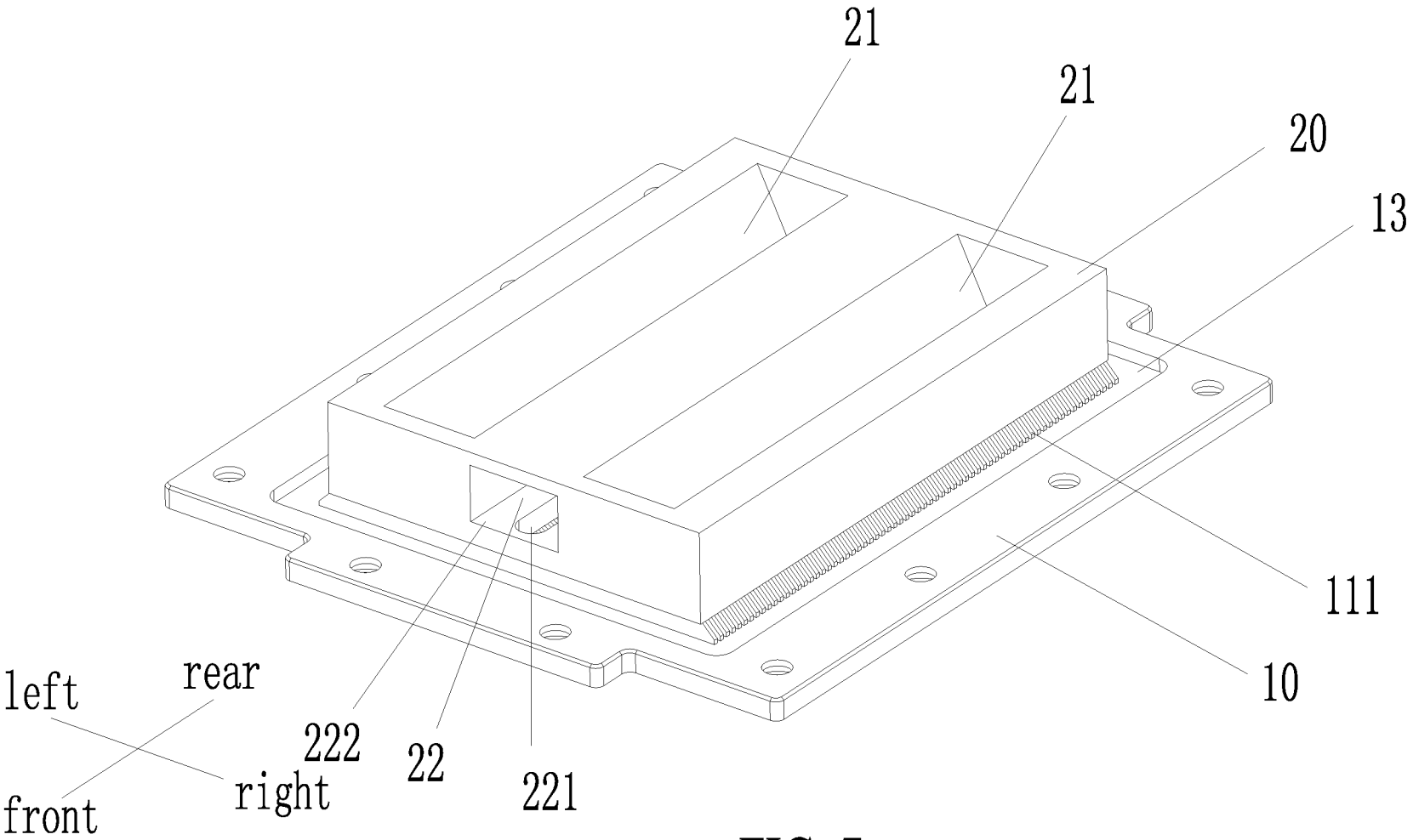
FIG. 7 is a perspective view of the heat sink base and the flow guide structure according to the first embodiment of the present invention.
Figure 8:
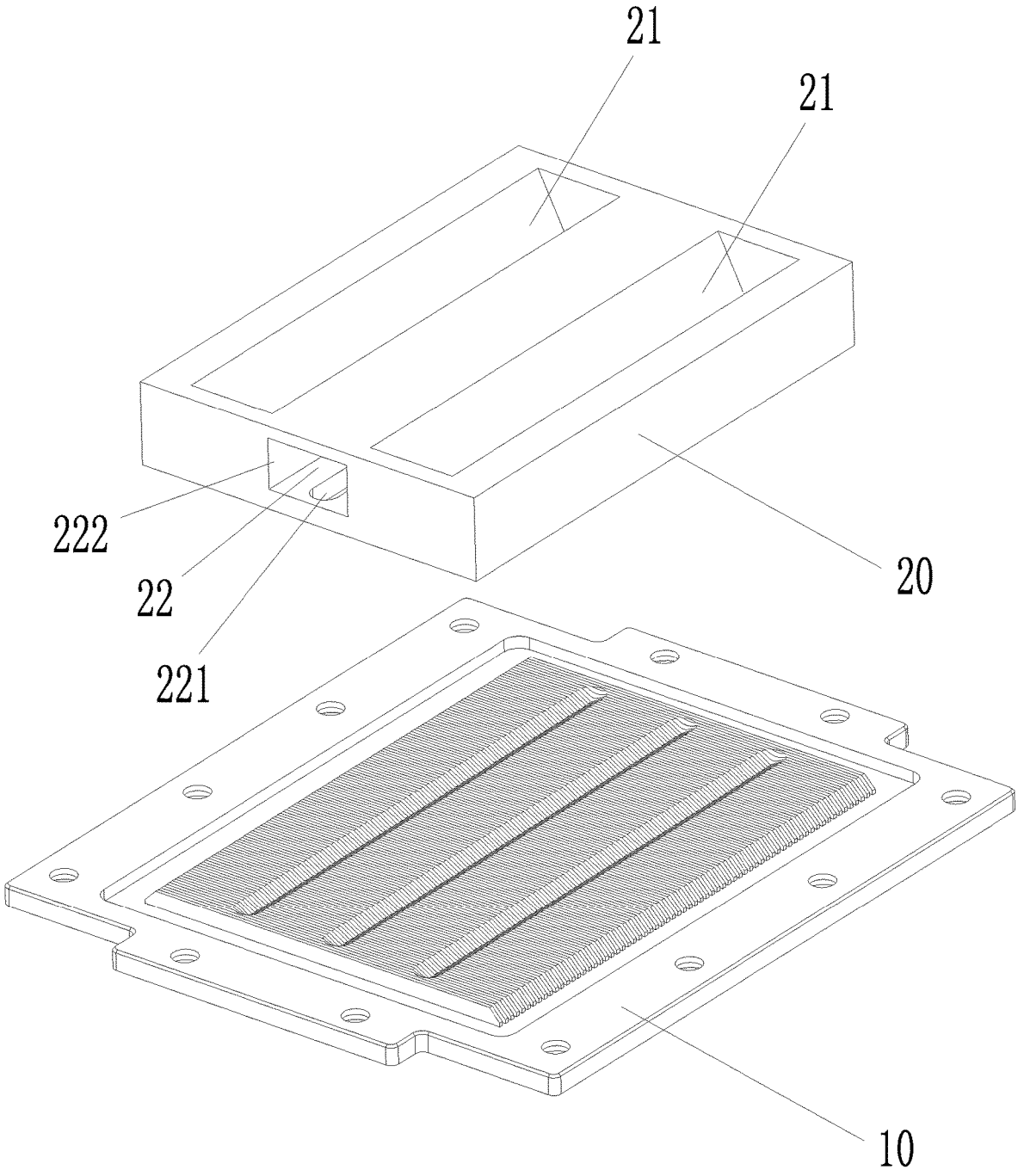
FIG. 8 is an exploded view of the heat sink base and the flow guide structure according to the first embodiment of the present invention.
Figure 9:
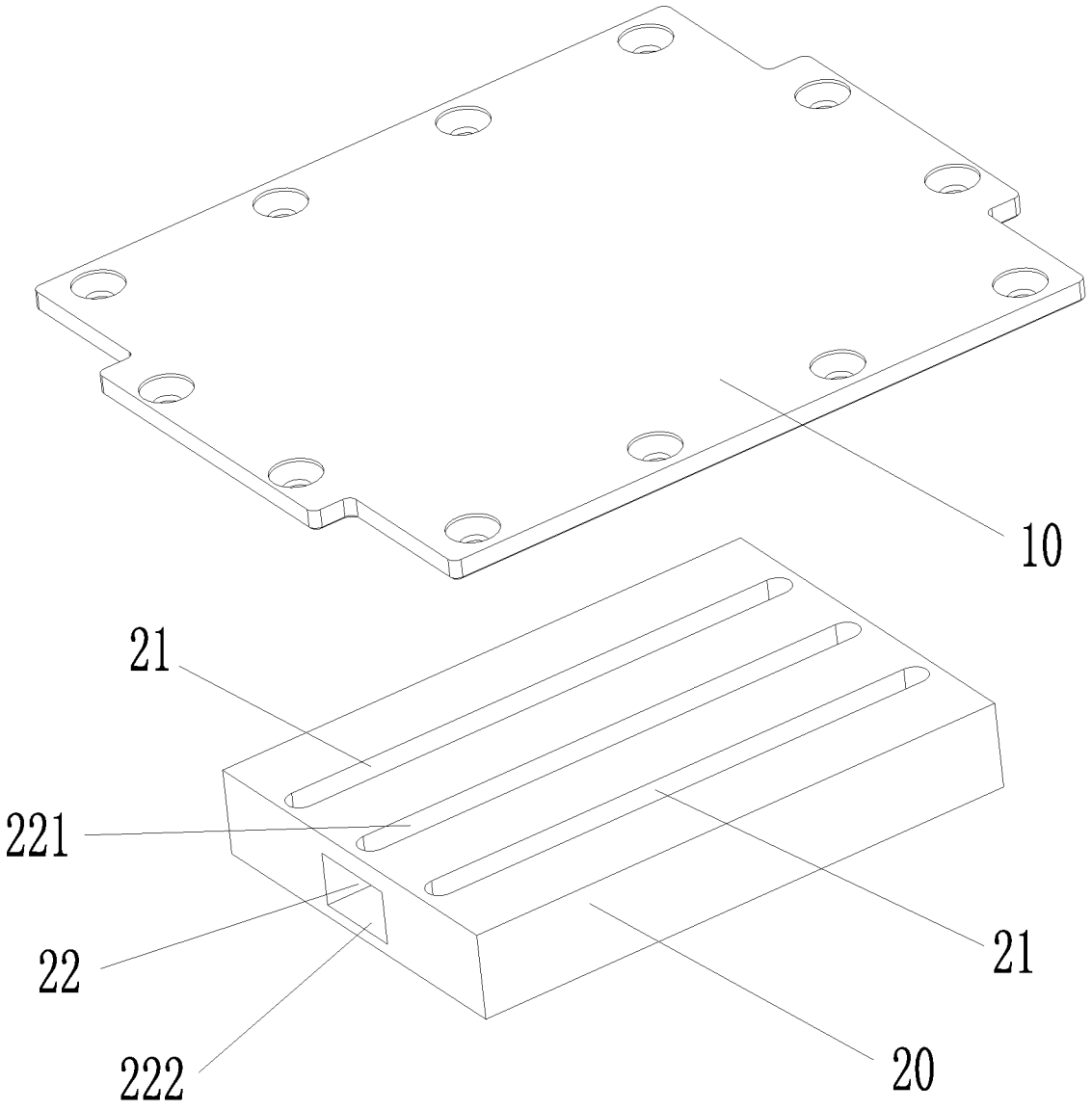
FIG. 9 is another exploded view of the heat sink base and the flow guide structure according to the first embodiment of the present invention.
Figure 10:
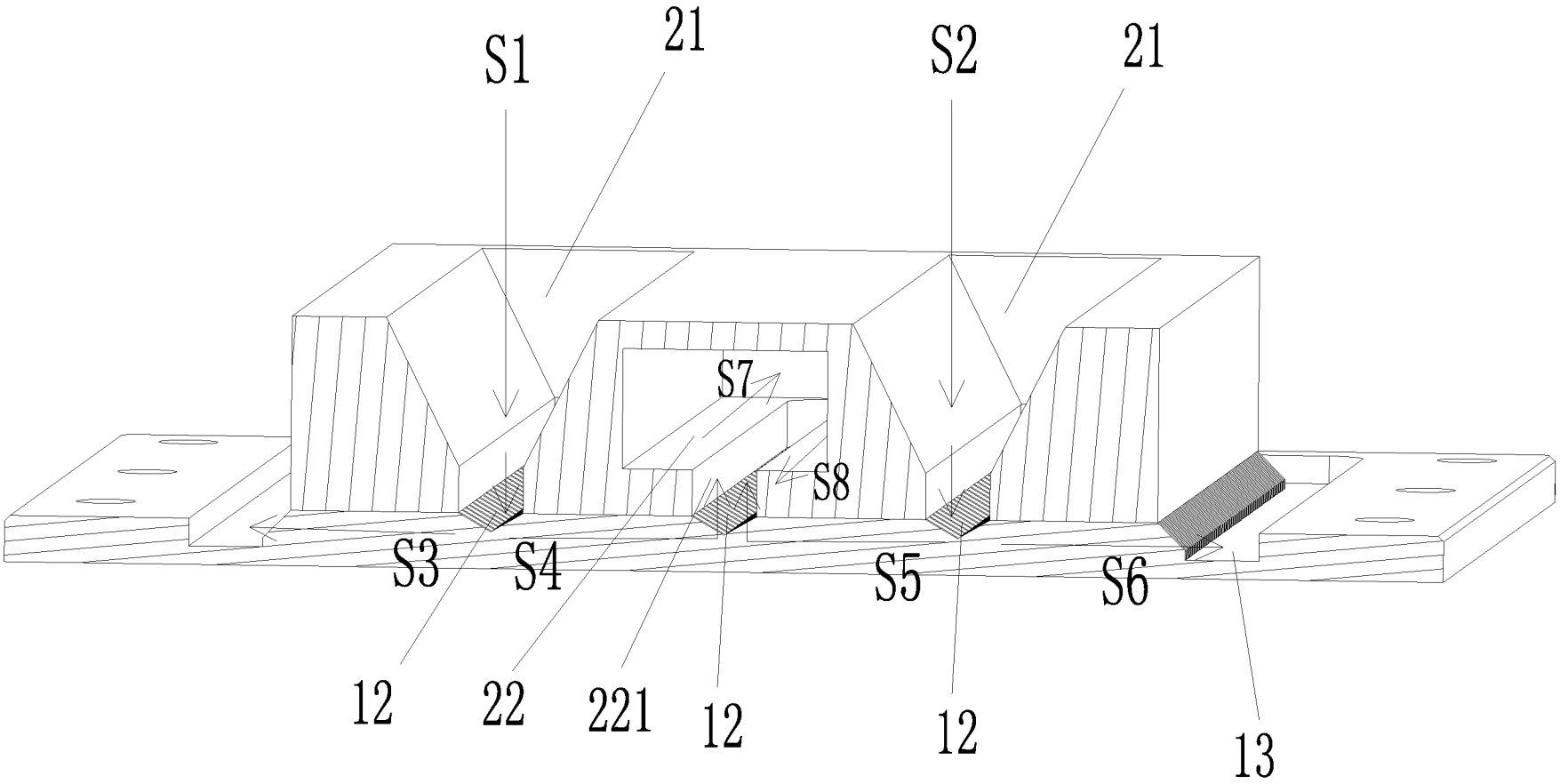
FIG. 10 is a cross-sectional view of the heat sink base and the flow guide structure according to the first embodiment of the present invention.
Figure 11:
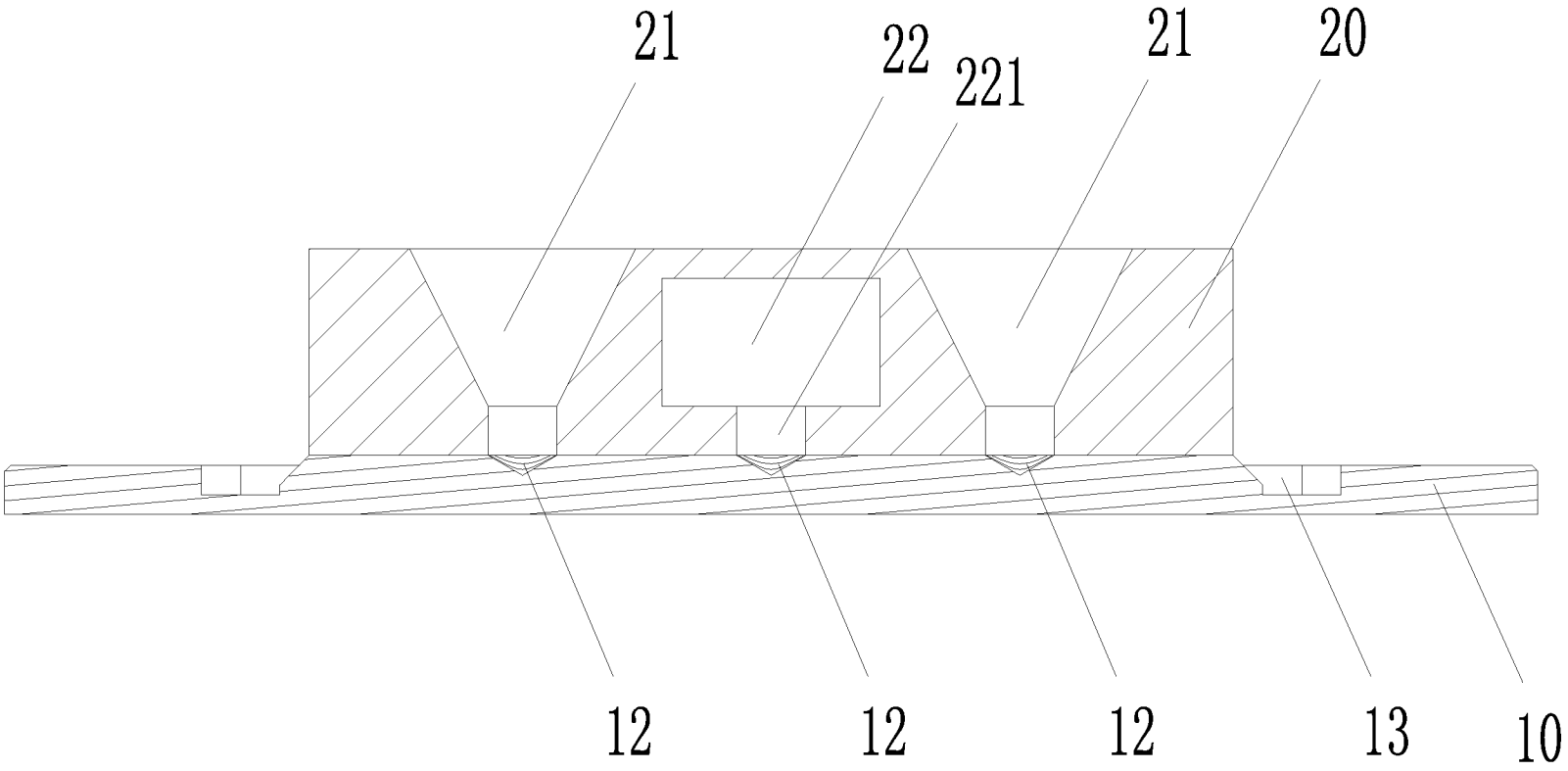
FIG. 11 is another cross-sectional view of the heat sink base and the flow guide structure according to the first embodiment of the present invention.
Figure 12:
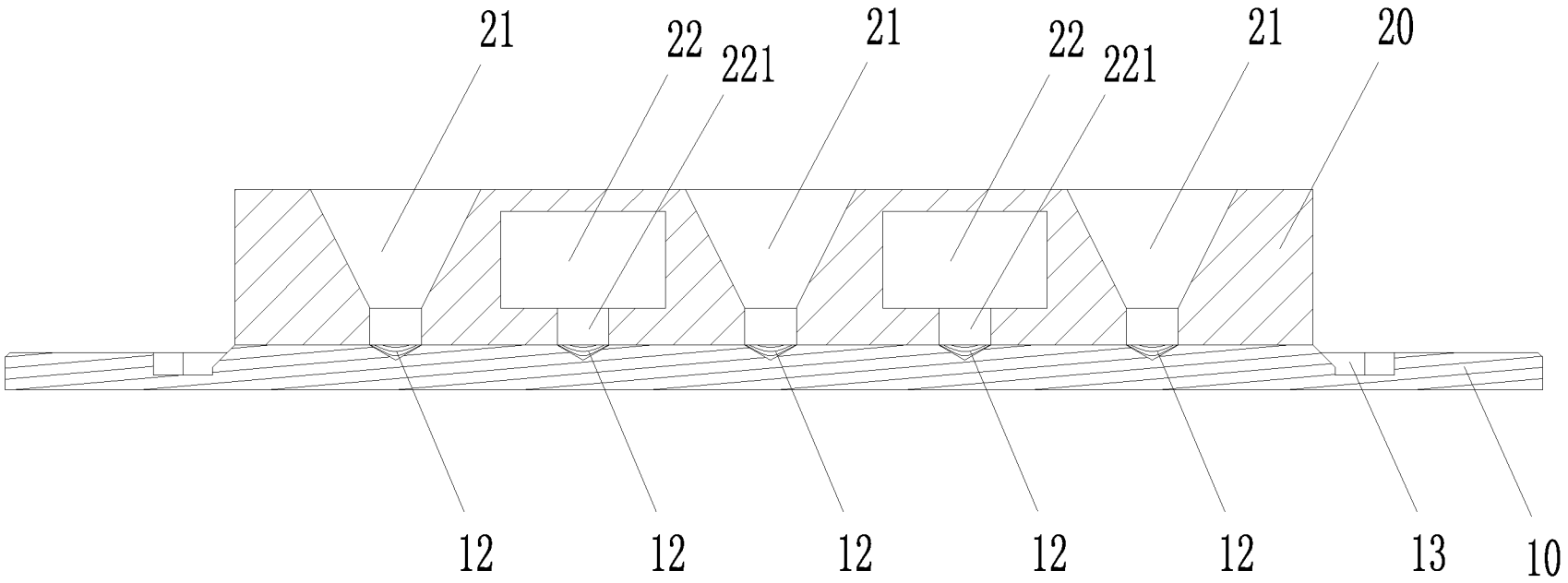
FIG. 12 is a cross-sectional view of the heat sink base and the flow guide structure according to the second embodiment of the present invention.
Figure 13:
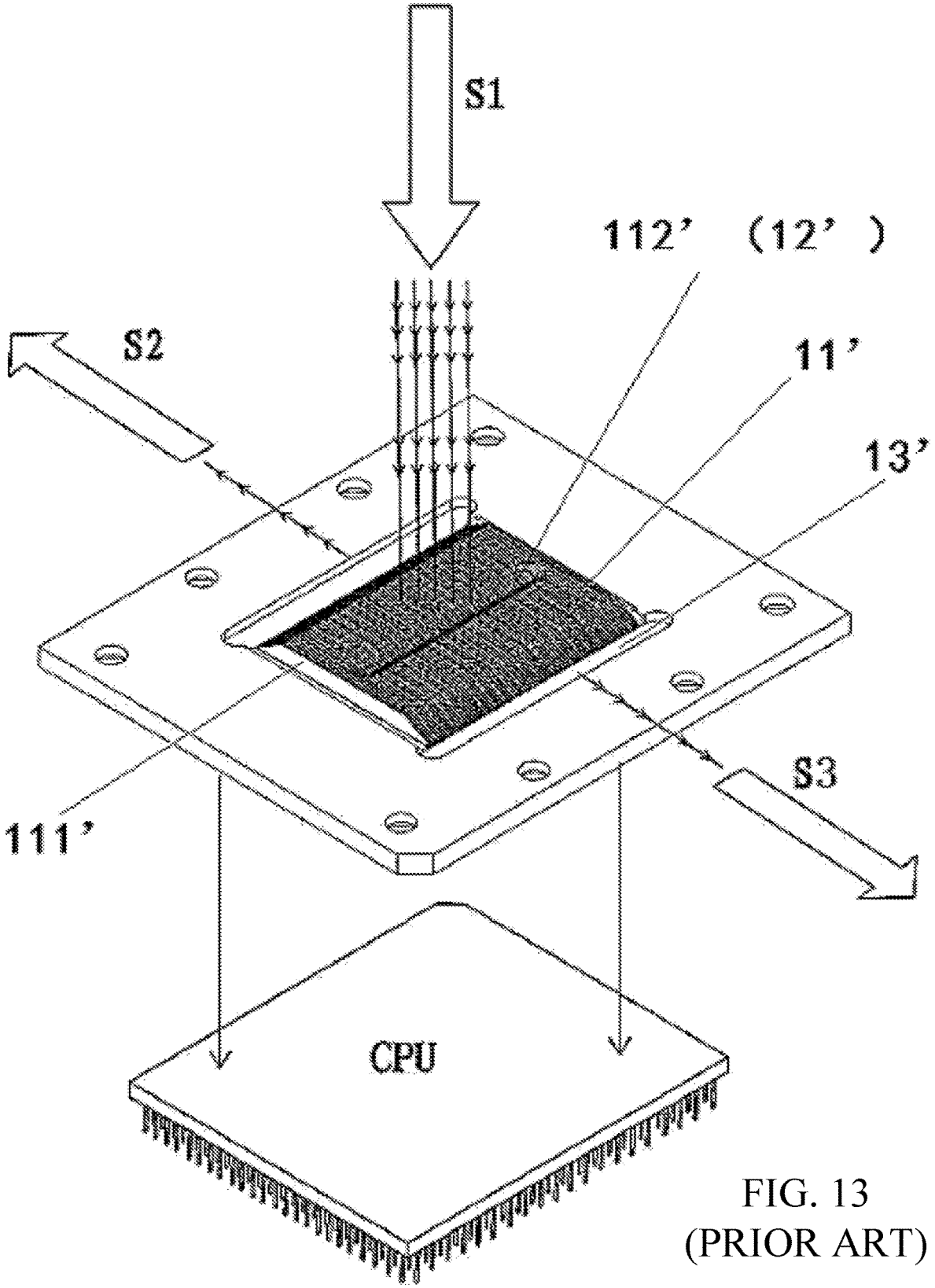
FIG. 13 (PRIOR ART)
FIG. 13 is a schematic view of a conventional liquid cooling radiator for a CPU.

As shown in FIG. 6 and FIG. 12, the number of the guide grooves 12 spaced apart in the left-right direction is five. The guide grooves 12 are defined from left to right as a first guide groove, a second guide groove, a third guide groove, a fourth guide groove, and a fifth guide groove. The number of the at least two diversion grooves 21 is three. The diversion grooves 21 are defined from left to right as a first diversion groove, a second diversion groove and a third diversion groove. The number of the at least one confluence groove 22 is two. The confluence grooves 22 are defined from left to right as a first confluence groove and a second confluence groove. The lower end of the first diversion groove communicates with the upper end of the first guide groove. The lower end of the second diversion groove communicates with the upper end of the third guide groove. The lower end of the third diversion groove communicates with the upper end of the fifth guide groove. The lower end of the first confluence groove 22 communicates with the upper end of the second guide groove. The lower end of the second confluence groove 22 communicates with the upper end of the fourth guide groove. Through the flow guide structure 20, the liquid is divided into three streams S1, S2 and S3 to enter the fin unit 11. After entering the fin unit 11, the stream S1 is divided into two streams S4 and S5 to flow left and right, the stream S2 is divided into two streams S6 and S7 to flow left and right, and the stream S3 is divided into two streams S8 and S9 to flow left and right. In this way, the flow resistance in the micro-channels of the fin unit 11 is reduced greatly. Besides, the stream S5 and the stream S6 are converged to enter the second guide groove and flow upwardly to the first confluence groove, and then flow out to the recess 13 via the liquid outlets 222 at the front and rear ends of the first confluence groove to form streams S10 and S11 in the first confluence groove. The stream S7 and the stream S8 are converged to enter the fourth guide groove and flow upwardly to the second confluence groove, and then flow out to the recess 13 via the liquid outlets 222 at the front and rear ends of the second confluence groove to form streams S12 and S13 in the second confluence groove. The stream S4 and the stream S9 flow from the left and right ends of the fin unit 11 to the recess 13, respectively. In this way, the five guide grooves 12 are evenly spaced in the left-right direction, which shortens the travel distance of the liquid to one-sixth.

What is claimed is:

1. A multi-channel liquid cooling radiator, comprising a heat sink base and a fin unit on the heat sink base, the fin unit including a plurality of fins that are arranged in parallel and spaced apart in a front-rear direction;

all or some of the fins of the fin unit each having at least three notches spaced apart in a left-right direction on a top thereof, wherein the notches, corresponding to each other in the front-rear direction, of the fins together form a guide groove extending in the front-rear direction, such that the top of the fin unit form at least three guide grooves spaced apart in the left-right direction;

a flow guide structure being provided on the heat sink base, the flow guide structure including at least two diversion grooves and at least one confluence groove, the diversion grooves and the confluence groove being arranged in parallel and spaced apart in the left-right direction, the confluence groove being located between every adjacent two of the diversion grooves, the diversion grooves passing through upper and lower ends of the flow guide structure, the confluence groove passing through the lower end of the flow guide structure, a front end and/or a rear end of the flow guide structure being formed with a liquid outlet communicating with the confluence groove;

lower ends of the diversion grooves and the confluence groove communicating with the corresponding guide grooves, respectively; wherein after a liquid enters the corresponding guide grooves from the diversion grooves, the liquid is diverted to flow left and right in a spacing between the fins, the liquid in the spacing of the fins at left and right sides of the guide groove corresponding to the confluence groove flows into the confluence groove, and then the liquid flows out from the liquid outlet of the confluence groove.

2. The multi-channel liquid cooling radiator as claimed in claim 1, wherein the heat sink base has a recess around a periphery of the fin unit, a left end and/or a right end of the spacing between the fins communicates with the recess, the liquid outlet of the confluence groove communicates with the recess, and the recess is connected to a hot liquid exit.

3. The multi-channel liquid cooling radiator as claimed in claim 2, wherein the recess is an annular recess around the fin unit.

4. The multi-channel liquid cooling radiator as claimed in claim 1, wherein the number of the guide grooves spaced apart in the left-right direction is three, the guide grooves are defined from left to right as a first guide groove, a second guide groove and a third guide groove; the number of the at least two diversion grooves is two, the diversion grooves are defined from left to right as a first diversion groove and a second diversion groove, the number of the at least one confluence groove is one; a lower end of the first diversion groove communicates with an upper end of the first guide groove, a lower end of the second diversion groove communicates with an upper end of the third guide groove, and the lower end of the confluence groove communicates with an upper end of the second guide groove.

5. The multi-channel liquid cooling radiator as claimed in claim 1, wherein the number of the guide grooves spaced apart in the left-right is five, the guide grooves are defined from left to right as a first guide groove, a second guide groove, a third guide groove, a fourth guide groove, and a fifth guide groove; the number of the at least two diversion grooves is three, the diversion grooves are defined from left to right as a first diversion groove, a second diversion groove and a third diversion groove; the number of the at least one confluence groove is two, the confluence grooves are defined from left to right as a first confluence groove and a second confluence groove; a lower end of the first diversion groove communicates with an upper end of the first guide groove, a lower end of the second diversion groove communicates with an upper end of the third guide groove, a lower end of the third diversion groove communicates with an upper end of the fifth guide groove, a lower end of the first confluence groove communicates with an upper end of the second guide groove, and a lower end of the second confluence groove communicates with an upper end of the fourth guide groove.

6. The multi-channel liquid cooling radiator as claimed in claim 1, wherein the guide groove is a V-shaped guide groove having a V-shaped cross-section.

7. The multi-channel liquid cooling radiator as claimed in claim 1, wherein the lower end of the confluence groove communicates with an upper end of the corresponding guide groove via a connection opening, and the connection opening has a cross-section smaller than that of the confluence groove.

* * * * *